United States Patent [19]

Moll

[11] Patent Number: 4,968,020

[45] Date of Patent: Nov. 6, 1990

[54] MANUALLY OPERATED FEEDER APPARATUS

[76] Inventor: Richard J. Moll, c/o Dick Moll & Sons, Warminster, Pa. 18974

[21] Appl. No.: 373,984

[22] Filed: Jun. 29, 1989

[51] Int. Cl.[5] ..... B65H 3/06

[52] U.S. Cl. ..... 271/114; 271/128

[58] Field of Search ..... 271/21, 22, 114, 116, 271/128

[56] References Cited

U.S. PATENT DOCUMENTS 2,042,734 6/1936 Roy ..... 271/21

4,550,902 11/1985 Godlewski ..... 271/21 X

*Primary Examiner*—Richard A. Schacher

*Attorney, Agent, or Firm*—Z. T. Wobensmith, III

[57] ABSTRACT

A manually operating feeding apparatus for feeding sheets of paper and the like which includes a link mechanism to rotate a shaft and actuate a one way friction feed to cause the sheets to be fed one at a time.

2 Claims, 2 Drawing Sheets

MANUALLY OPERATED FEEDER APPARATUS

BACKGROUND OF THE INVENTION

1. Field of the Invention

A manually operated feeding apparatus for feeding sheets of paper and the like which is of the multiple linkage type.

2. Description of the Prior Art

An inexpensive reliable manually operated feeding apparatus for feeding sheets of paper in folding machines and the like has long been a goal of the printing industry.

Motor driven feeding apparatus for feeding sheets of paper for subsequent processing are common in the printing industry. An example of such apparatus is shown in my prior application Ser. No. 240,565, filed Sept. 6, 1988. Such apparatus is complicated, requires a power supply, an air supply, motors, gears and controls for safe operation. Many shops do not wish to incur the cost of motor driven apparatus nor require an expensive complicated feeding apparatus, but have need of a simple easily operated feeding apparatus.

The apparatus of the invention can be manually operated by one person and is useful in a wide variety of machines.

SUMMARY OF THE INVENTION

This invention relates to a manually operated feeding apparatus for feeding sheets of paper and the like to take single sheets from a stack and through multiple links rotates shafts to engage a one way wheel to feed the sheets from the stack one at a time for processing.

The principal object of the invention is to provide a manually operated feeding apparatus which advances sheets of paper and the like one at a time from a stack for further processing.

A further object of the invention is to provide apparatus of the character aforesaid that is easy to operate and can be used in a wide variety of machines.

A further object of the invention is to provide apparatus of the character aforesaid which is simple and inexpensive to construct but reliable and long lasting in operation.

A further object of the invention is to provide apparatus of the character aforesaid which can be operated by one person.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

Figure 1:
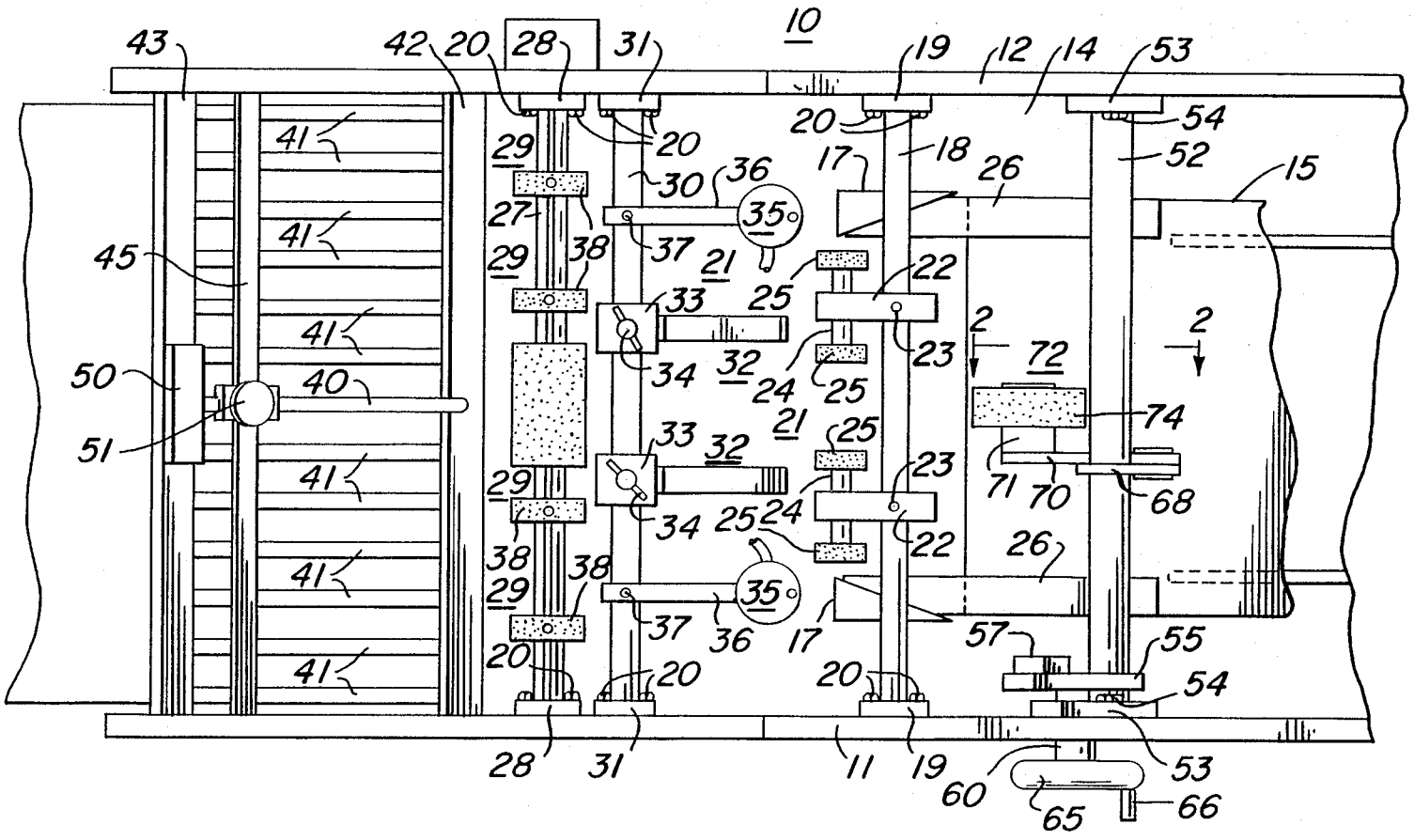
FIG. 1 is a top plan view of a portion of a folding machine incorporating the feeding apparatus of the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings a portion of a folding machine 10 is therein illustrated which includes side plates 11 and 12, and transverse bed plate 14. The machine 10 is illustrated with a stack 15 of sheets of paper which is supported and raised on a plate (not shown) under the stack 15 in well known manner. The sheets 16 of paper from stack 15 are restrained from upward movement by guides 17 mounted to transverse bar 18, which bar is engaged in flanges 19 secured by bolts 20 to plates 11 and 12. Bar 18 also has two adjustable hold downs 21 thereon which include an arm 22 on bar 18, which is secured thereto by set screw 23 and supports axles 24 which each have a pair of wheels 25 to engage a sheet of paper 16 to be fed.

A second set of guides 26 is provided along the edges of the sheets 16 also mounted (not shown) to transverse bar 18.

To the left of bar 18 as shown in FIG. 1, another transverse bar 30 is provided engaged in flanges 31 fastened to side plates 11 and 12 by bolts 20. The bar 30 has at least two hold down guides 32 mounted thereto by brackets 33, and thumb screw 34 and adjustable about the bar 30.

A plurality of glue applying heads 35 are provided mounted to bar 30 by arms 36 and set screws 37 to provide lines of glue (not shown) on the sheets of paper 16 are required.

To the left of bar 30 an additional shaft 27 is provided extending between plates 11 and 12 and journaled in bearings 28 mounted thereto by bolts 20. The shaft 28 has a plurality of collars 29 thereon with outer coverings 38, and which shaft may be driven manually or by a motor (not shown). A delivery section 40 is provided to the left of bar 30, which includes a plurality of separated longitudinally extending members 41 mounted to transverse members 42 and 43, which are mounted to side plates 11 and 12. An additional transverse bar 45 is provided mounted to plates 11 and 12 above members 42, and with an adjustable guide and hold down member 50 mounted thereto by screw 51 engaged with bar 45.

Figure 2:
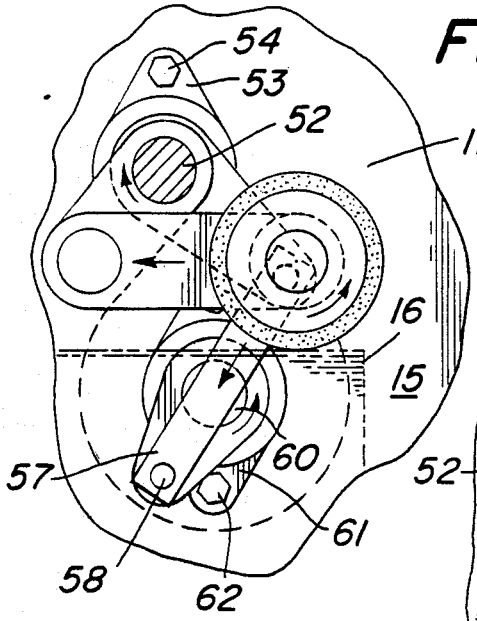
FIG. 2 is a vertical sectional view, enlarged, taken approximately on the line 2—2 of FIG. 1, illustrating a portion of the feeding apparatus of the invention in one position.
Figure 4:
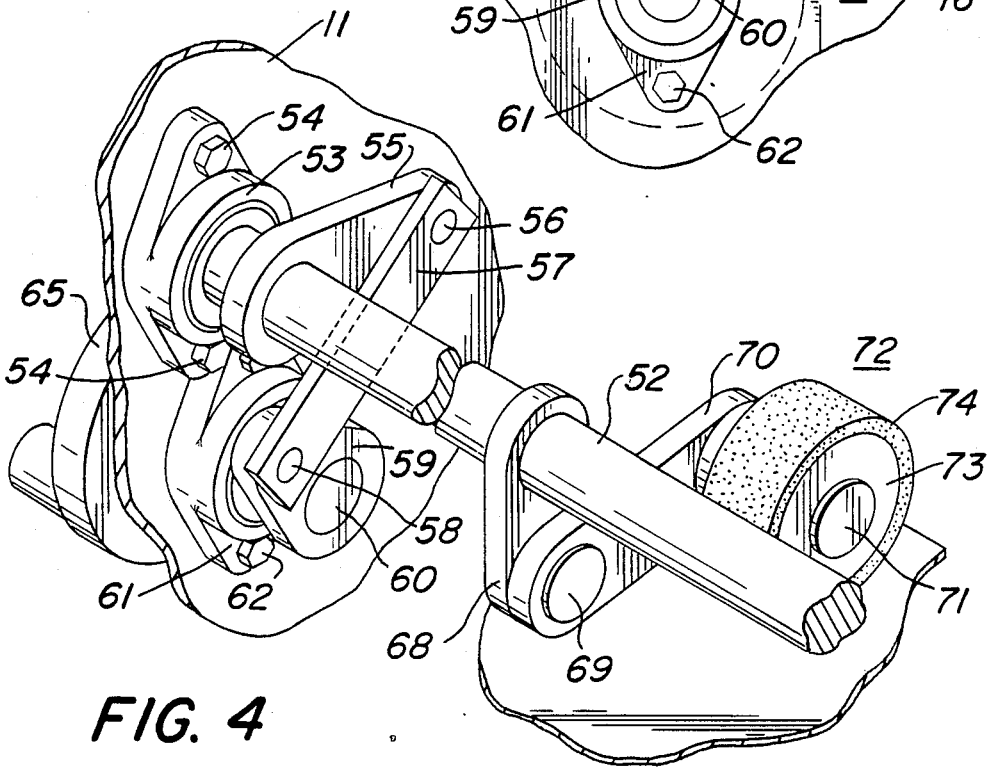
FIG. 4 is a fragmentary perspective view, illustrating the feeding apparatus of the invention.

To the right of bar 18 a transversely extending shaft 52 is provided, which is journaled in bearings 53 mounted to side plates 11 and 12 by bolts 54. The shaft 52 adjacent bearings 53 on side plate 11 has an arm 55 fixedly secured thereto in well known manner, such as by welding, and has a pivot pin 56 therein engaged by a connecting link 57 which is engaged by a pivot pin 58 in an arm 59 mounted to a stub shaft 60. The stub shaft 60 is journaled in bearing 61 mounted to side plate 11 by bolts 62, the shaft 60 passing through plate 11 with a wheel 65 secured thereto, which has a handle 66 thereon for rotation. The shaft 52 over the sheets 16 has a link 68 secured thereto, which extends vertically in the at rest position of FIG. 4 and has a pivot pin 69 engaged therewith, and with a link 70 which has an axle 71 extending therefrom to mount a one way rotation wheel 72. The wheel 72 has a well known machanism (not shown) therein to permit the wheel 72 to rotate in the counterclockwise direction as shown in FIG. 2, but which locks and does not permit clockwise rotation of wheel 72.

The wheel 72 includes a hub 73 and an outer tire or covering 74 which can engage a sheet of paper 16 to be fed under the glue heads 35 for processing to be described.

Figure 3:
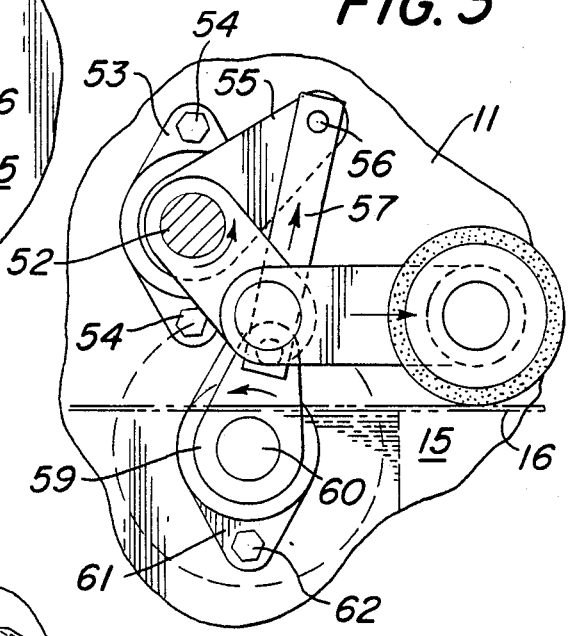
FIG. 3 is a view similar to FIG. 2, illustrating a portion of the feeding apparatus of the invention in another position.

The mode of operation will now be pointed out. When it is desired to feed sheets of paper 16 the wheel 65 is rotated counterclockwise as seen in FIGS. 2 and 3, causing shaft 60 to rotate and through arm 59 move connecting link 57' to the left which moves arm 55 counterclockwise downwardly causing shaft 52 to rotate clockwise and link 70 to rotate clockwise and move wheel 72 to the left while rotating counterclockwise. When arm 59 is at its leftmost position as shown in FIG. 2, further rotation causes shaft 52 to rotate counterclockwise, the wheel 72 interior mechanism (not shown) to lock and wheel 72 to engage a sheet of paper 16 and moves it to the right as shown in FIG. 3. Continued rotation of wheel 61 continues the back and forward movement of wheel 72 causing successive sheets of paper 16 to be fed as desired.

It will thus be seen that apparatus has been provided with which the objects of the invention are achieved.

I claim:

1. In a machine wherein successive sheets of paper and the like are to be fed from a stack of sheets one at a time which machine includes side plates, and apparatus for feeding which comprises a shaft transversely extending between and journaled in bearings in said side plates, an arm fixedly mounted to said shaft adjacent one of said plates, a connecting link rotatably engaged with said arm, another arm rotatably engaged with said link and mounted to a stub shaft, said stub shaft journaled in a bearing mounted to a side plate, a wheel connected to said stub shaft for rotation of said stub shaft, sheet engaging means for feeding individual sheets from a stack, said sheet engaging means including a third arm fixedly mounted to said transversely extending shaft, a second link rotatably engaged with said third arm, an axle engaged with said second link, and a one way rotating wheel mounted to said axle.

2. Apparatus as defined in claim 1 in which said rotating wheel has an outer covering for frictional engagement with said sheets.

* * * * *